US007124719B2

(12) United States Patent
Ariyakunakorn

(10) Patent No.: US 7,124,719 B2
(45) Date of Patent: Oct. 24, 2006

(54) TWO-WAY CYLINDER ENGINE

(76) Inventor: Amorn Ariyakunakorn, 2587 New Petchburi Road, Kwang Suanluang, Ket Suanluang 10250 (TH)

( * ) Notice: Subject to any disclaimer, the term of this patent is extended or adjusted under 35 U.S.C. 154(b) by 0 days.

(21) Appl. No.: 11/155,267

(22) Filed: Jun. 17, 2005

(65) Prior Publication Data

US 2005/0229876 A1 Oct. 20, 2005

Related U.S. Application Data

(62) Division of application No. 10/736,206, filed on Dec. 15, 2003, now Pat. No. 6,948,458.

(30) Foreign Application Priority Data

Feb. 12, 2003 (TH) ..... 080049

(51) Int. Cl.
*F01L 7/06* (2006.01)
*F01L 7/00* (2006.01)

(52) U.S. Cl. ..... 123/80 D; 123/190.14; 123/190.15

(58) Field of Classification Search ..... 123/80 D, 123/190.14, 190.15
See application file for complete search history.

(56) References Cited

U.S. PATENT DOCUMENTS 2,247,984 A * 7/1941 Bensinger et al. ..... 123/80 D
2,457,206 A * 12/1948 Carlson ..... 123/190.14
4,106,443 A 8/1978 Triulzi
4,612,886 A * 9/1986 Hansen et al. ..... 123/190.14
4,944,261 A 7/1990 Coates
4,989,558 A 2/1991 Coates
5,103,778 A 4/1992 Usich
5,558,049 A * 9/1996 Dubose ..... 123/80 D
5,813,372 A 9/1998 Manthey
6,601,548 B1 8/2003 Al-Hawaj
6,672,263 B1 1/2004 Vallejos
2003/0011137 A1* 1/2003 Dubose ..... 277/500

* cited by examiner

*Primary Examiner*—Noah P. Kamen
(74) *Attorney, Agent, or Firm*—Ladas & Parry LLP

(57) ABSTRACT

An internal combustion engine wherein each cylinder has two pistons placed in the opposite direction and attached together by an arm-type connecting rod and wherein a cylinder head has a rotor blade rotating in the middle between the upper cylinder head and the lower cylinder head whereby the upper cylinder head and the lower cylinder head are perforated with an intake port and an exhaust port. The rotor blade is perforated with one port and rotates by a gear which is at the outer edge of the rotor blade. When the piston reaches the power stroke, it generates force to act on the arm-type connecting rod and when the connecting rod arm moves in a linear motion, it transmits the force towards the crankshaft or the transmission shaft which is attached by a guide rail platform.

18 Claims, 12 Drawing Sheets

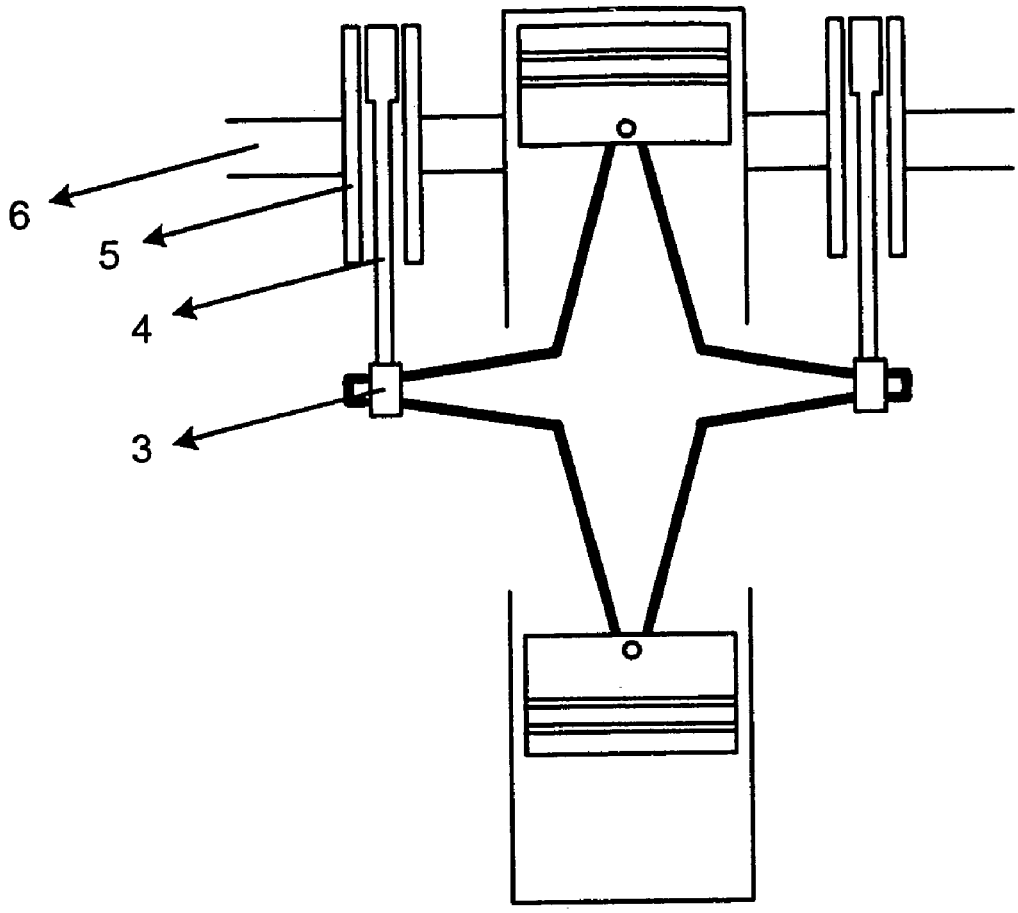
Fig. 5.1
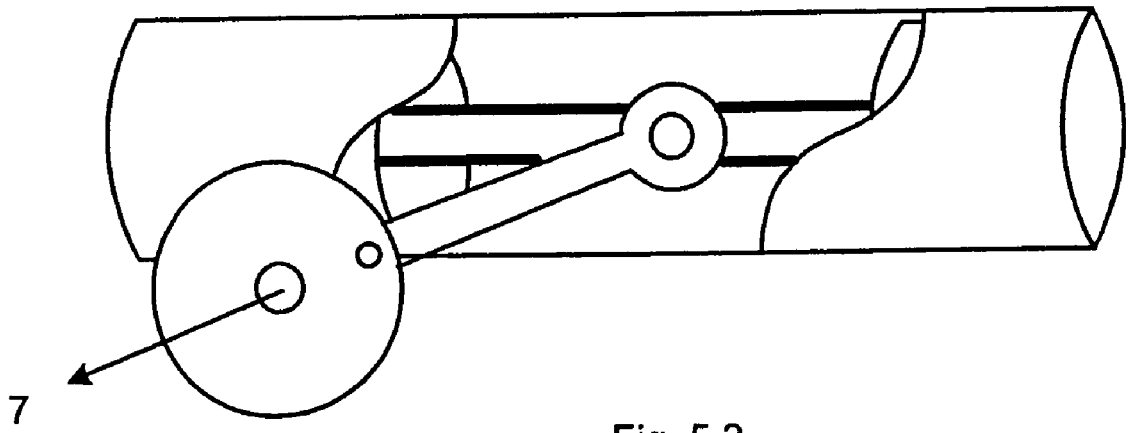
Fig. 5.2

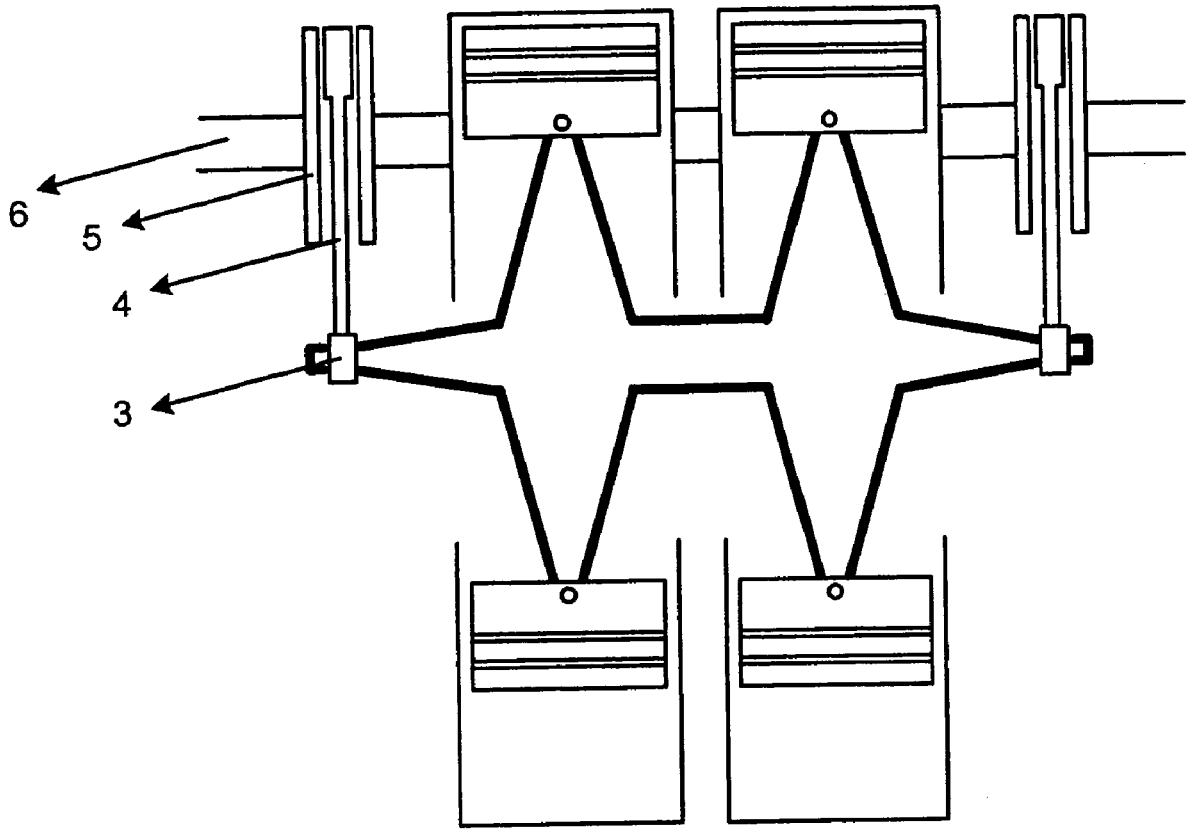
Fig. 5.3
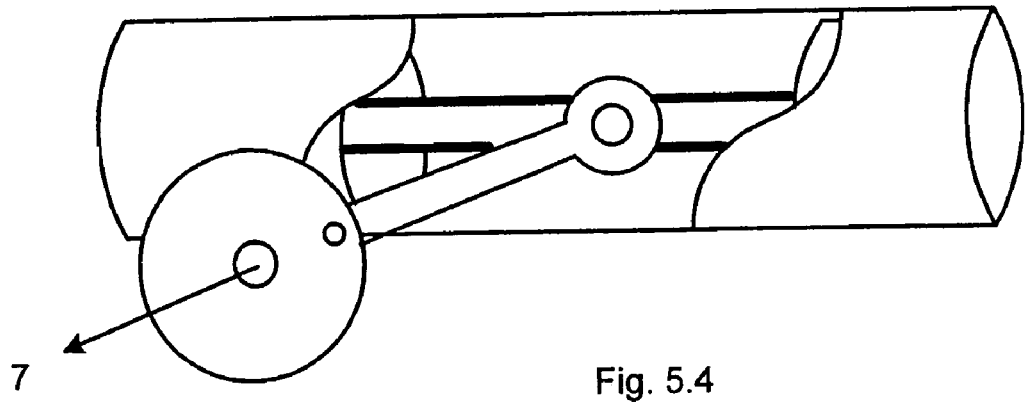
Fig. 5.4

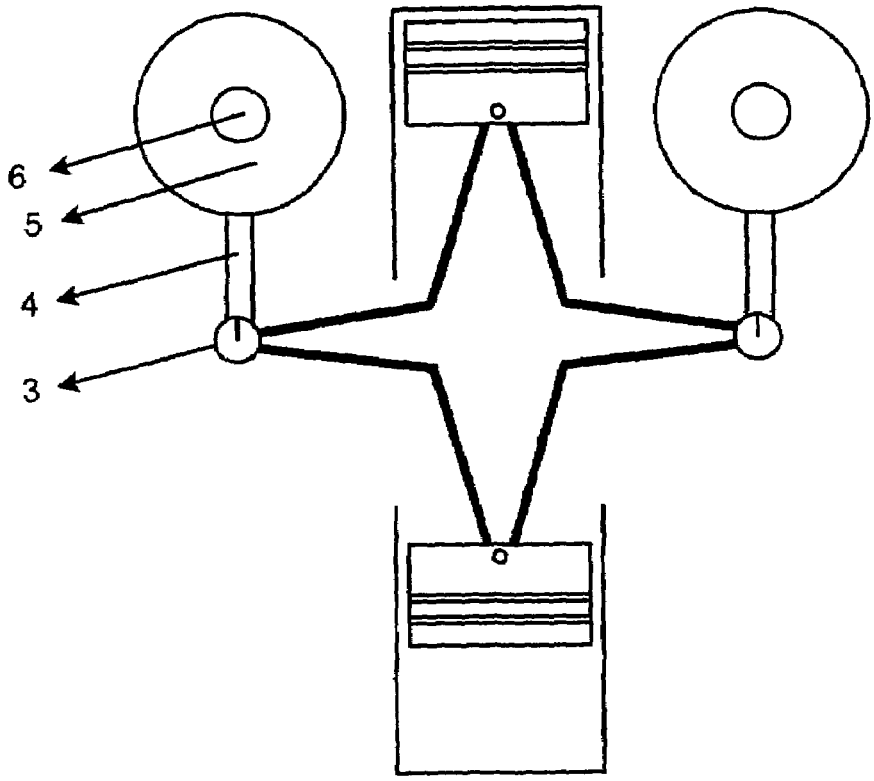
Fig. 6.1
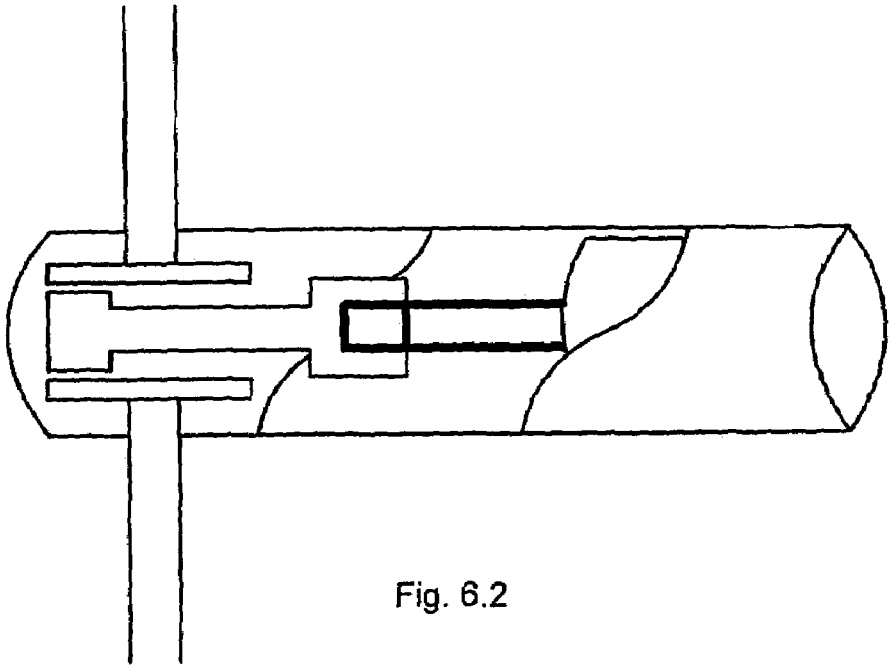
Fig. 6.2

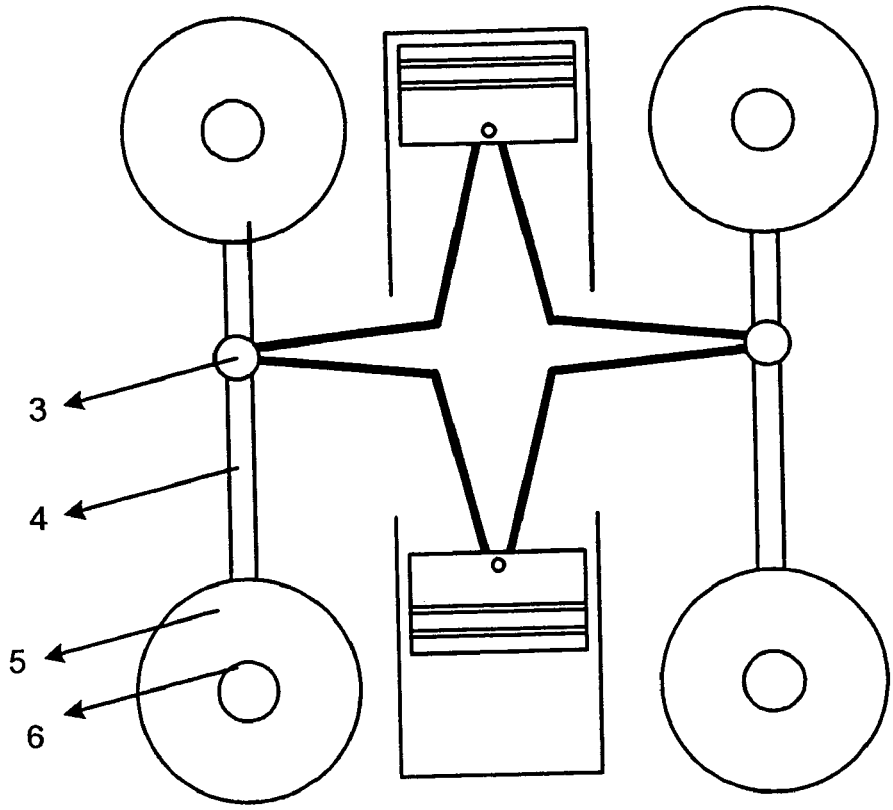
Fig. 7.1
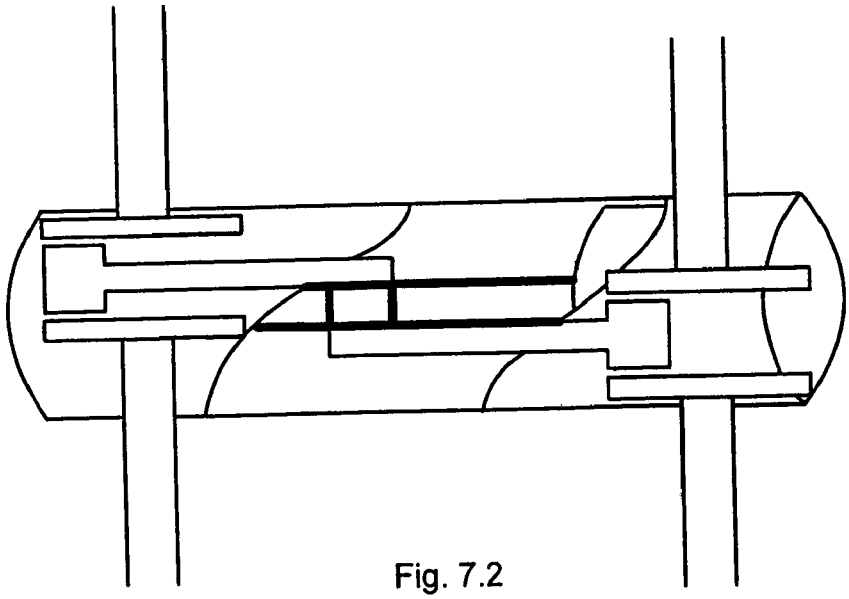
Fig. 7.2

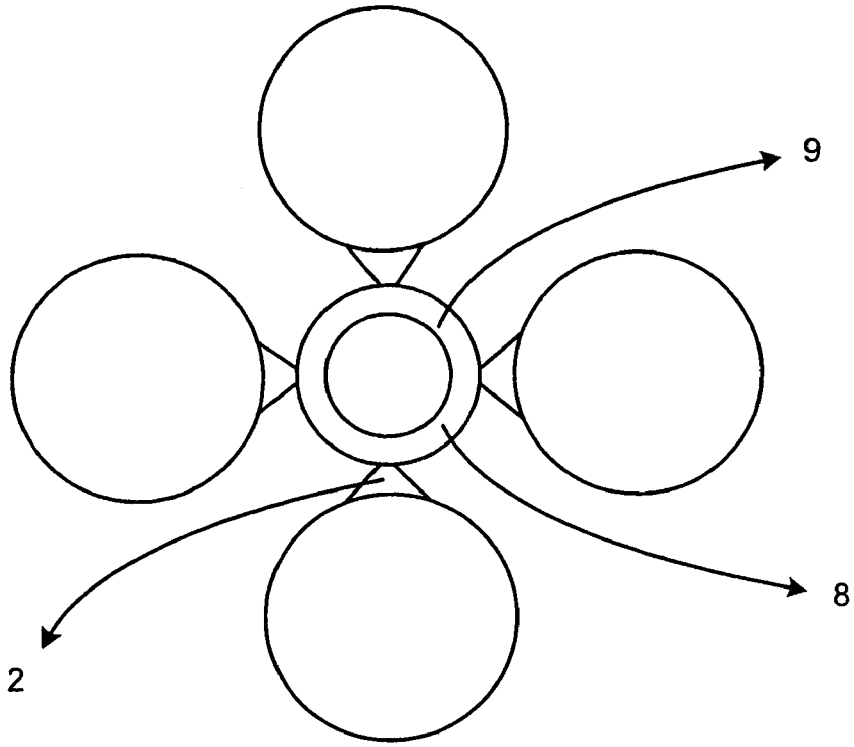
Fig. 12
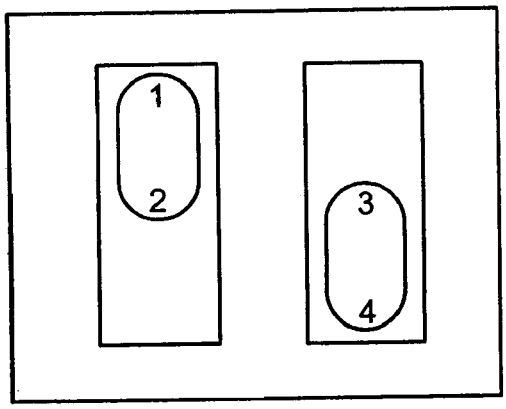
Fig. 13.1
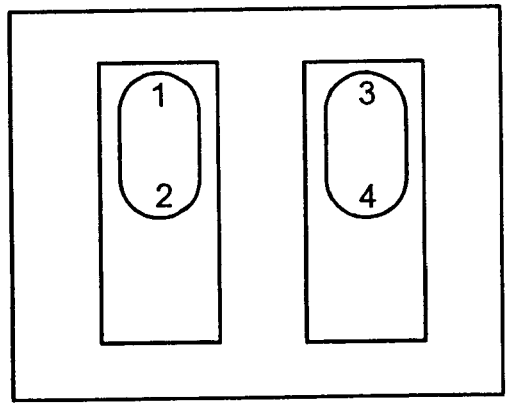
Fig. 13.2

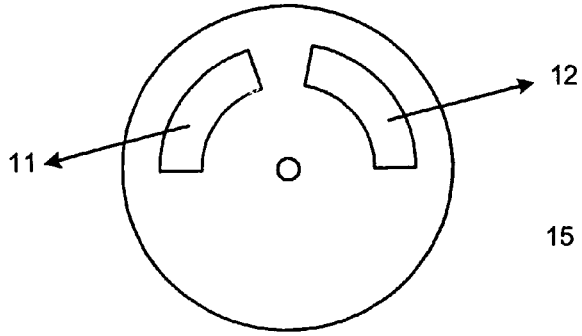
Fig. 14.1
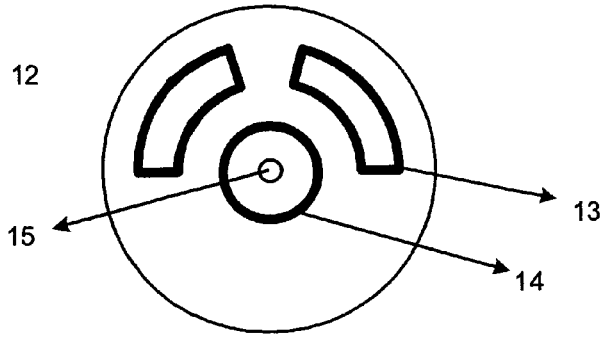
Fig. 14.2
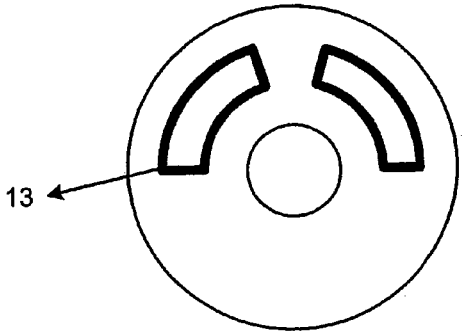
Fig. 14.3
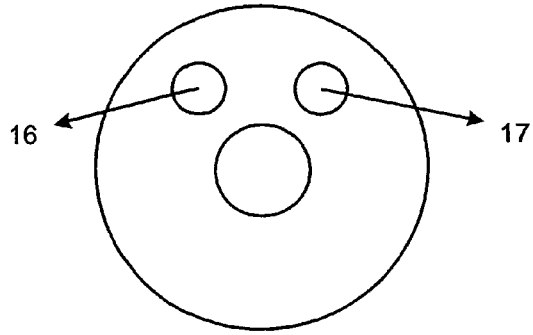
Fig. 14.4
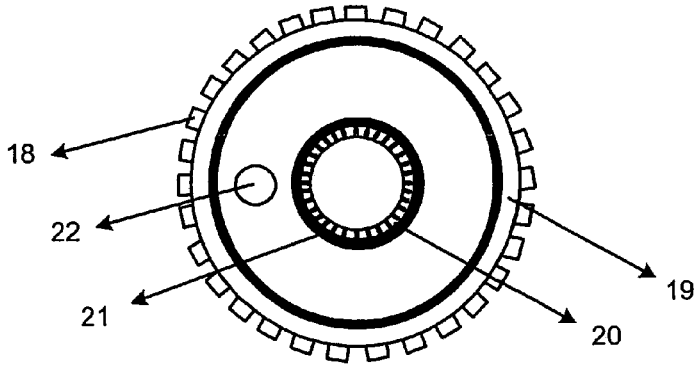
Fig. 14.5

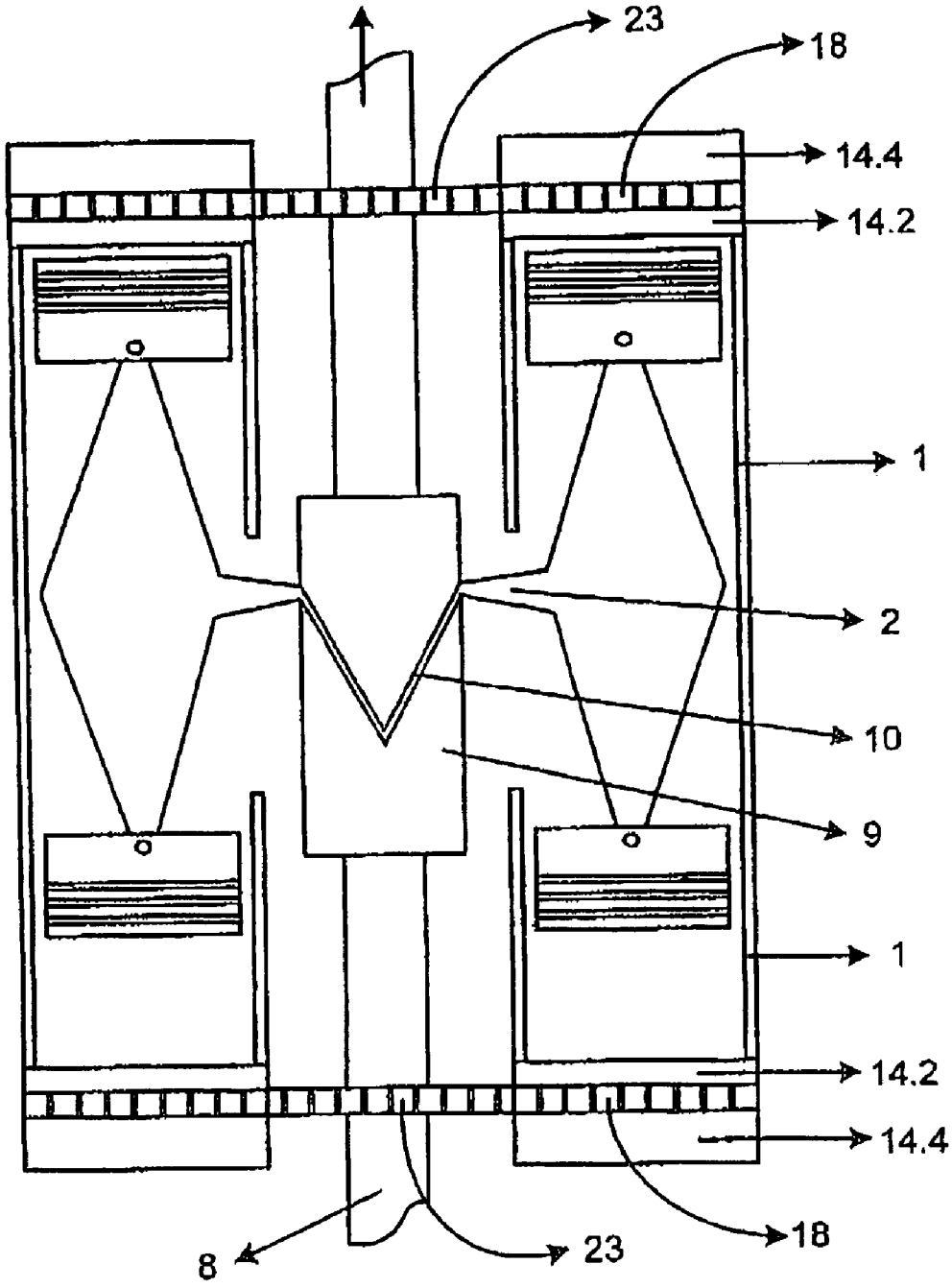
*Fig.* 15

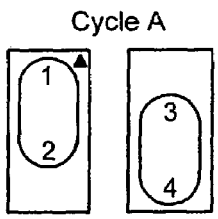
Fig. 17.1
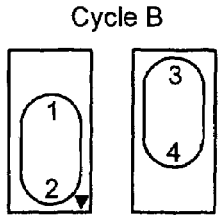
Fig. 17.2
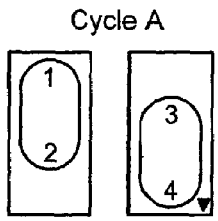
Fig. 17.3
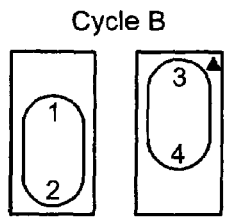
Fig. 17.4
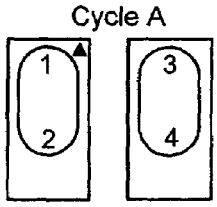
Fig. 17.5
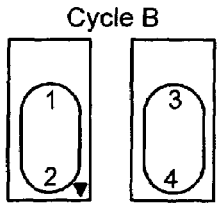
Fig. 17.6
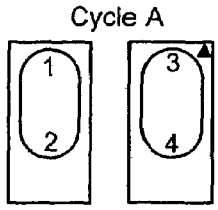
Fig. 17.7
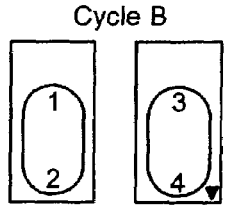
Fig. 17.8
Fig. 17
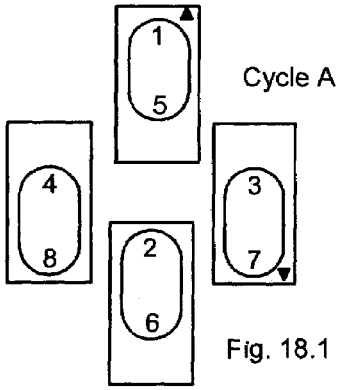
Fig. 18.1
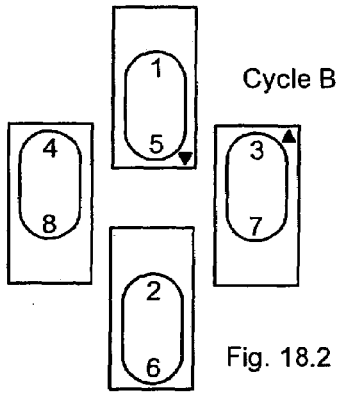
Fig. 18.2
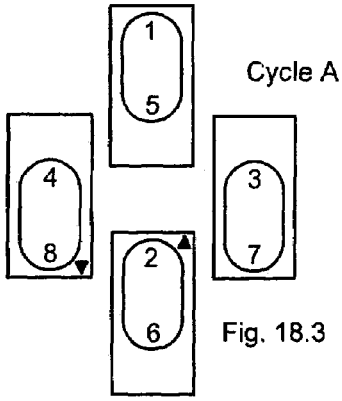
Fig. 18.3
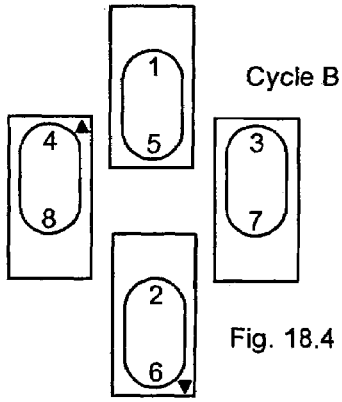
Fig. 18.4
Fig. 18

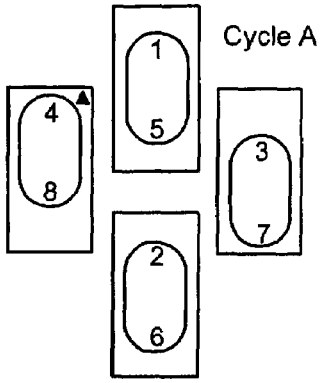
Fig. 19.1
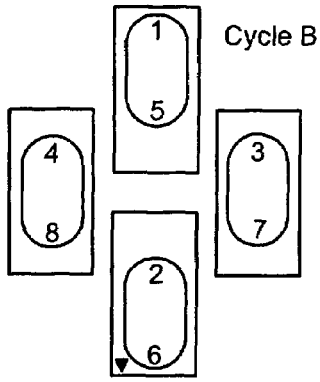
Fig. 19.2
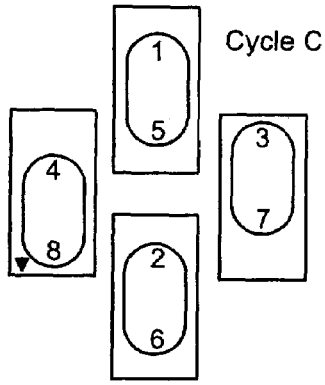
Fig. 19.3
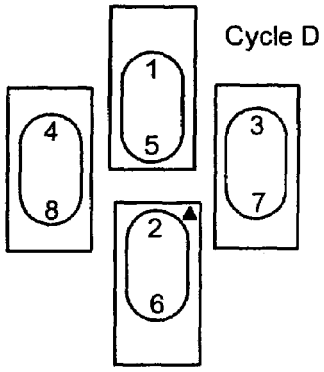
Fig. 19.4
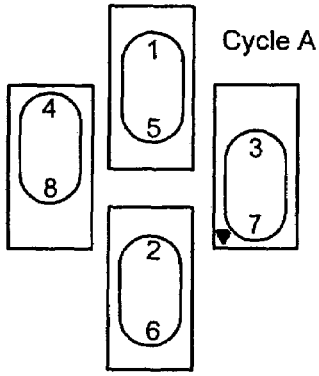
Fig. 19.5
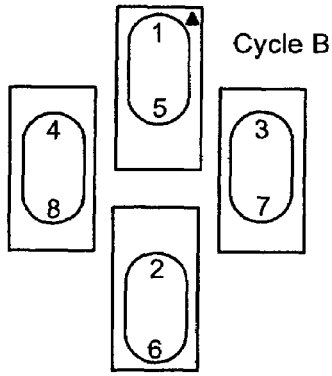
Fig. 19.6
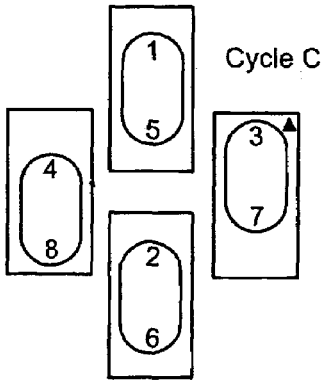
Fig. 19.7
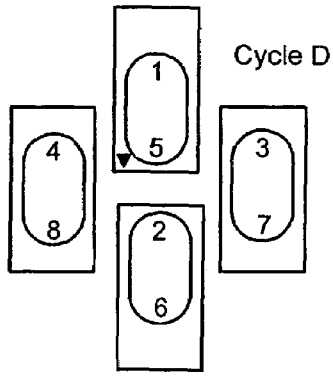
Fig. 19.8
Fig. 19

TWO-WAY CYLINDER ENGINE

This application is a divisional of Ser. No. 10/736,206, dated Dec. 12, 2003, now U.S. Pat. No. 6,948,458.

NATURE AND PURPOSE OF THE INVENTION

An engine having 2-sided pistons in a single cylinder and moving in a linear motion to reduce the lateral friction of the pistons with a view to providing the pistons to have less wear and tear and to move in a balanced motion by using less parts than an engine at present.

FIELD OF THE INVENTION

Engine engineering and engineering relating to engines.

BACKGROUND OF THE INVENTION

Four-stroke internal combustion engines which are in use today are subjected to development and improvement continually but their original power transmission form namely the pistons transmitting power to a connecting rod and towards a crankshaft cannot be developed. The movement of the pistons in an engine normally generates friction on a lateral side of the pistons which is the rolling radius side of a crank. The friction causes the pistons and the cylinder to undergo wear and tear and lose energy. Moreover, crankshafts which are in use today have light weight and the friction thus causes energy loss in a useless manner. When a close patent is taken into account such as U.S. Pat. No. 4,106,443 which relates to cylinder heads, there is great development nowadays. However, there are limitations in respect of the size and the number of valves which cause obstacles in the flow of an air-fuel mixture and exhaust gases. Previous development of cylinder heads has dealt with the development of spherical rotary valve assemblies as shown in U.S. Pat. Nos. 4,944,261; 4,989,558. For this new engine type, a cylinder head is constructed to have a rotor blade rotatably fitted in place of a valve. Therefore, the purpose of the present invention is to the construct an assembly with a reduced number of parts and to provide smooth flow of an air-fuel mixture and exhaust gases without the valve face to obstruct the flow of an air-fuel mixture and exhaust gases.

BRIEF DESCRIPTION OF THE DRAWINGS

FIG. 5 A form of an engine with a one-shaft type two-way piston.

FIG. 6 A form of an engine with a 2-shaft type two-way piston.

FIG. 7 A form of an engine with a 4-shaft type two-way piston.

FIG. 12 A form of a 4-cylinder engine with two-way pistons using a guide rail platform.

FIG. 13 A form of the positioning of the piston of a 2-cylinder type two-way piston engine.

FIG. 14 A figure showing the detail of the cylinder head of an engine.

FIG. 15 A figure showing the detail of a 4-cylinder type two-way piston engine using a single guide rail platform and a single connecting rod arm.

FIG. 17 A layout showing the position of the piston and the position of the ignition of a 2-cylinder type two-way piston engine.

FIG. 18 A layout showing the position of the piston and the position of the ignition of a 4-cylinder type two-way piston engine using a single guide rail platform.

FIG. 19 A layout showing the position of the piston and the position of the ignition of a 4-cylinder type two-way piston engine using a double parallel guide rail platform.

DETAILED DISCLOSURE OF THE INVENTION

Figure 1:
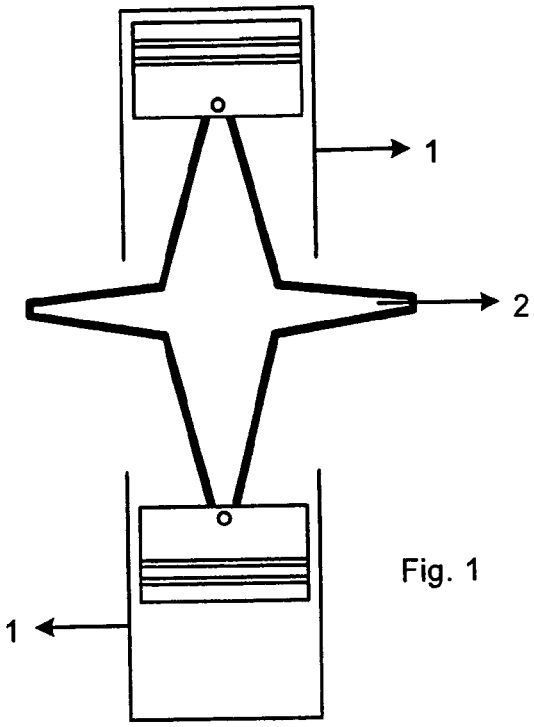
FIG. 1 A two-way cylinder and a balanced-arm type connecting rod.
Figure 2:
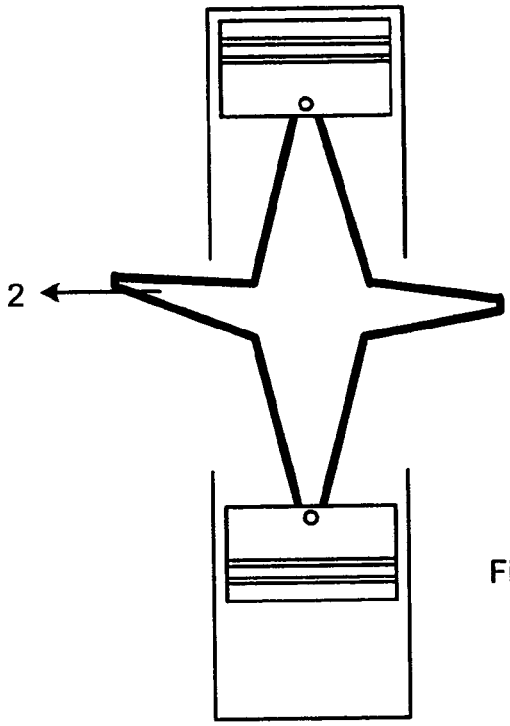
FIG. 2 A two-way cylinder and an oblique-arm type connecting rod in a model of an engine using a double parallel guide rail platform.
Figure 3:
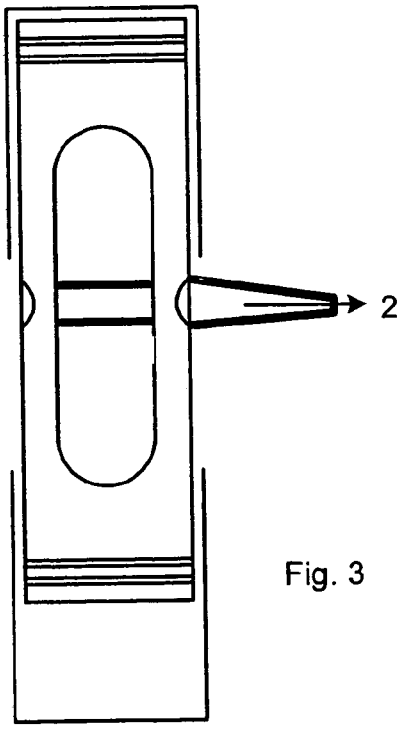
FIG. 3 A two-way cylinder and two-way pistons using a single arm type connecting rod.
Figure 4:
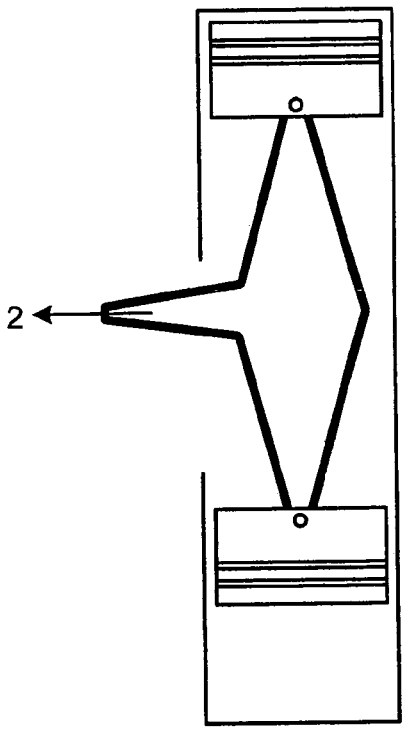
FIG. 4 A two-way and a single arm type connecting rod in a model of an engine using a single guide rail platform.

An object of the present invention is to allow the pistons to move in a linear motion only. The engine having 2-sided pistons (FIG. 1) in an opposite position or a two-way piston (FIG. 3) has space for chambers at the head and the rear of the two-way piston which 2-sided pistons jointed together by a connecting rod or a two-way piston to move in a two-way cylinder (1) having a connecting rod which has an extending arm (hereinafter referred to as the connecting rod arm). The connecting rod arm (3) will transfer the power of the two pistons at a power stroke to the shaft with various forms of power transmission as follows:

A.1 It is designed to provide the transmission of power to one crankshaft only.

A.2 It is designed to provide the transmission of power to two crankshafts.

A.3 It is designed to provide the transmission of power to four crankshafts.

A.4 It is designed to provide the transmission of power to a drive shaft by a guide rail platform.

A.1 A design providing the transmission of power to one crankshaft by making a connecting rod arm (3) to be an axis for another connecting rod (4) to fit together and the connecting rod (4) joins a crank (5) by having a crankshaft (6) rotating horizontally opposing the line of the two-way cylinder which is in a horizontal direction (FIG. 5.1). The force derived from 2 pistons will be transmitted to the connecting rod arm at both sides in an equal amount thus causing the pistons to move in a balanced motion while the cranks at both sides which are connected to the double connecting rod arm can be designed to be light weight. The crankshaft which is fitted transversely will be eccentrically at the motion line of a connecting rod arm (7) and thus causing the crankshaft movement to sustain reduced friction.

A.2 A design providing the transmission of power to 2 crankshafts by making a connecting rod arm (3) to be an axis for another connecting rod (4) to fit together and the connecting rods (4) join a crank (5) by having crankshafts (6) rotating perpendicularly to the two-way cylinder while the crankshafts are separated in such a way that each crankshaft is at each side of the two-way cylinder along the connecting rod arm (6) and have synchronous rotations at both shafts.

A.3 A design providing the transmission of power to 4 crankshafts by making a connecting rod arm (3) to be an axis for another two connecting rods (4) to fit together and the connecting rod (4) joins a crank (5) by having crankshafts (6) rotating perpendicularly to the two-way cylinder while the crankshafts are separated in such a way that two crankshafts are at each side along the connecting rod arm (FIG. 7) and thus causing the 4 crankshafts to have synchronous rotations in a balanced motion at all sides.

Figure 8:
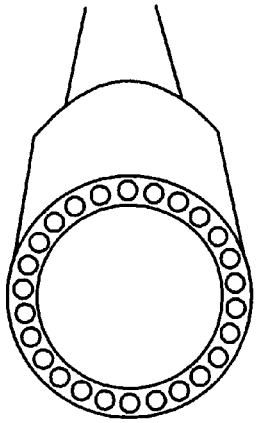
FIG. 8 The end of a connecting rod arm fitted with a ball sleeve.
Figure 16:
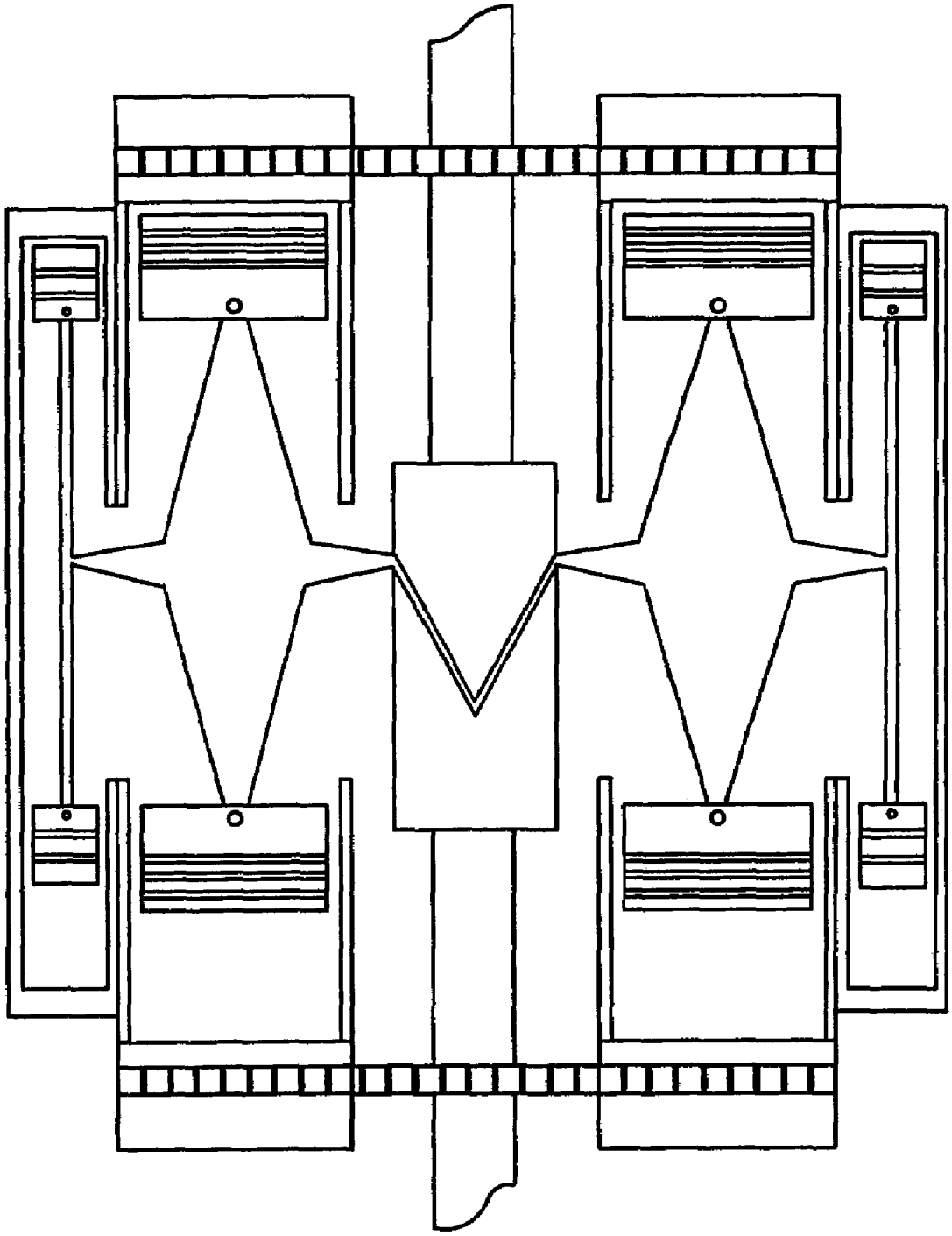
FIG. 16 A figure showing the detail of a 4-cylinder type two-way piston engine using a single guide rail platform and a balanced connecting rod arm.

A.4 A design providing the transmission of power to a drive shaft by a guide rail platform by making the end of the connecting rod arm (3) to be a ball sleeve (FIG. 8). A transmission shaft (8) is tightly fitted with a guide rail platform (9). The transmission shaft is fitted parallel to the two-way cylinder whereas the connecting rod arm at the side where it is constructed as a ball sleeve is in the rail (10) of the guide rail platform (9) while the connecting rod arm at another side is fitted to a small connecting rod (FIG. 16) in a small two-way cylinder fitted laterally to the two-way cylinder which functions as an engine oil pump. It does not whether the connecting rod arm which is attached to the small connecting rod in the small two-way cylinder is present or not. The design to provide transmission to the drive shaft directly comprises one two-way cylinder or more. For the purpose of balance, at least 2 two-way cylinders should be fitted in the same plane and their clearance from both sides of the transmission shaft should be equal and this number can be increased to 4 cylinders with the transmission shaft being at the center surrounded by 4 two-way cylinders. Each cylinder has an equal clearance from the transmission shaft and forms an angle of 90 degrees, 180 degrees, 270 degrees and 360 degrees (FIG. 12). The end of the connecting rod arm of each two-way cylinder is in the rail of the guide rail platform with the pistons being placed alternately in each two-way cylinder.

The operation of a linear motion piston is as follows:

Referring to FIG. 13, the piston 1 is at the highest position, moving down to perform the intake stroke of the piston 1. When moving towards the lowest position, it ascends to perform the compression stroke and performs the power stroke when ascending to the highest position to generate power and descends to the lowest position and then ascends to perform the exhaust stroke. At the highest position, a new cycle begins. The movement to the highest and lowest positions also produces an effect on piston 2 on the opposite direction.

The ignition of piston 1 and piston 2 should be determined in successive positions. That is to say, after the piston 1 is at the highest ignition position when it descends, it means piston 2 begins to ascend. When the piston 1 is at the lowest position, the piston 2 is at the highest ignition position.

With the above principle, designs A.1, A.2, A.3 can work even with 1 two-way cylinder. If continuous operations and balance are required, there should be 2 or more two-way cylinders.

Regarding design A.4, there should be at least 2 two-way cylinders for balanced operations and 4 two-way cylinders for balanced and continuous operations.

The Operation of the New Piston is as Follows:

The cylinder head is constructed as 2 layers with a spherical rotor blade (FIG. 14.5) rotating between the upper cylinder head (FIG. 14.2) and the lower cylinder head (FIG. 14.3). The lower cylinder head (FIG. 14.1) is perforated with 2 ports whereby the two ports are on the hemisphere of the cylinder head sphere (FIG. 14.1). An intake port (12) and an exhaust port (11) of the upper cylinder head in contact with the rotor blade (FIG. 14.2) are provided with a seal (11) to prevent leakage pressure around both ports. The middle of the top of the lower cylinder head (FIG. 14.2) is constructed with an edge in high relief (14) with a port for a spark plug (15) while the high-relief edge is the core for a rotor blade. The rotor blade is of a circular nature with its outermost edge having gear teeth (18) to which a seal (19) is fitted to prevent leakage pressure at both sides of the rotor blade. The middle of the rotor blade is perforated with a hole having a size equal to the width of the high-relief edge of the lower cylinder head. The inner edge of the rotor blade is fitted with ball bearings (20) to reduce friction and a seal (21) prevent leakage pressure is fitted to the edge of ball bearings at both sides of the rotor blade. There is one port (22) perforated between the inner and outer sides of the leakage pressure prevention seal (FIG. 14.5). The lower cylinder head (FIG. 14.3) in contact with the rotor blade is perforated with an intake port and an exhaust port (FIG. 14.3) which is similar to the lower cylinder head and in the corresponding position. The edges of the intake port and exhaust port are fitted with a seal (13) to prevent leakage pressure. The upper part of the upper cylinder head is perforated to receive an intake port (17) and an exhaust port (16). The middle of the upper cylinder head is perforated with a hole having a size equal to the width of the high-relief edge of the lower cylinder head (FIG. 14.4).

When the lower cylinder head and the upper cylinder head have been assembled already, there is a space exactly fit the width of the rotor blade. The rotation between the rotor blade and gears (23) in designs A.1, A.2, A.3 has a gear ratio of 1:2. For design A.4, the gearing ratios are different between the fitting of 2 two-way cylinders which has a gear ratio similar to design A.1, A.2, A.3 and the fitting of 4 two-way cylinders which has a gear ratio of 1:1. The opening and closing of the flow of an air-fuel mixture and exhaust gases use a reduced number of parts and facilitate a better flow of an air-fuel mixture and exhaust gases. In operation, the parts of the rotor blade requires no special lubrication.

Operation of an Overall Engine

The design A.1 engine operate with only one two-way cylinder. If continuous power is required, 2 or more two-way cylinders should be used by fitting parallel and placing the pistons of each cylinder as per FIG. 13.1, FIG. 13.2.

FIG. 17.1, 17.3 Cycle A Pistons (1), (4) ascend to the highest positions Pistons (2), (3) descend to the lowest positions FIG. 17.2, 17.4 Cycle B Pistons (2), (3) ascend to the highest positions Pistons (1), (4) descend to the lowest positions FIG. 17.5, 17.7 Cycle A Pistons (1), (3) ascend to the highest positions Pistons (2), (4) descend to the lowest positions FIG. 17.6, 17.8 Cycle B Pistons (2), (4) ascend to the highest positions Pistons (1), (3) descend to the lowest positions FIG. 17.1 Piston (1) is at the ignition position.

FIG. 17.2 Piston (2) is at the ignition position.

FIG. 17.3 Piston (4) is at the ignition position.

FIG. 17.4 Piston (3) is at the ignition position.

FIG. 17.5 Piston (1) is at the ignition position.

FIG. 17.6 Piston (2) is at the ignition position.

FIG. 17.7 Piston (3) is at the ignition position.

FIG. 17.8 Piston (4) is at the ignition position.

The operation of the design A.1 engine which is a two-way cylinder type is one ignition per each cycle when the piston ascends to the highest position and descends to the lowest position and thus producing continuous torque down to the crankshaft. In fitting the crankshaft in the design A.1 engine, the center of the crankshaft with the motion line of the connecting rod arm should not exceed 45 degrees from the line of the two-way cylinder.

The design A.2 engine operates in the same manner as the design A.1 engine in all respects except the transmission of power to the crankshafts where there are 2 crankshafts perpendicular to the line of the two-way cylinder while the left crankshaft and the right crankshaft rotate synchronously.

The design A.3 engine operates in the same manner as the design A.2 engine in all respects including the transmission of power to the crankshafts. However, there is an additional crankshaft present at each side whereby the 4 crankshafts rotate simultaneously and synchronously.

The design A.4 engine which has 2 two-way cylinders operates in the same manner as the engines of designs A.1, A.2, A.3 in all respects.

The design A.4 engine which has 4 two-way single rail type cylinder operates as follows: (FIG. 18).

FIG. 18 Cycle A Pistons (1), (2) ascend to the highest point. Pistons (5), (6) descend to the lowest point. Pistons (7), (8) ascend to the highest point Pistons (3), (4) descend to the lowest point.

Cycle B Pistons (5), (6) ascend to the highest point Pistons (1), (2) descend to the lowest point. Pistons (3), (4) ascend to the highest point. Pistons (7), (8) descend to the lowest point.

FIG. 18.1 This causes piston (1) and piston (7) to be at the ignition position in cycle A.

FIG. 18.2 This causes piston (5) and piston (3) to be at the ignition position in cycle B.

FIG. 18.3 This causes piston (2) and piston (8) to be at the ignition position in cycle A.

FIG. 18.4 This causes piston (6) and piston (4) to be at the ignition position in cycle B.

The operation of the design A.4 engine which has 4 two-way single rail type cylinders is that in cycle A, each time there is ignition at two pistons in the opposite direction and in cycle B, each time there is ignition at two pistons in the opposite direction. This results in one rotation of the transmission shaft with 8 times of ignition from 4 two-way cylinders. The power obtained from the engine has continual high torque with reduced vibration.

The design A.4 engine which has 4 two-way double parallel rail type cylinders operates as follows:

FIG. 19 Cycle A Pistons (4), (7) ascend to the highest point Pistons (8), (3) descend to the lowest point. Pistons (1), (2), (5), (6) are at the middle Cycle B Pistons (1), (6) ascend to the highest point Pistons (5), (2) descend to the lowest point. Pistons (3), (4), (7), (8) are at the middle Cycle C Pistons (3), (8) ascend to the highest point. Pistons (7), (4) descend to the lowest point. Pistons (1), (2), (5), (6) are at the middle Cycle D Pistons (2), (5) ascend to the highest point. Pistons (6), (1) descend to the lowest point. Pistons (3), (4), (7), (8) are at the middle FIG. 19.1 The piston (4) is set to be at the ignition position in cycle A.

FIG. 19.2 The piston (6) is set to be at the ignition position in cycle B.

FIG. 19.3 The piston (8) is set to be at the ignition position in cycle C.

FIG. 19.4 The piston (2) is set to be at the ignition position in cycle D.

FIG. 19.5 The piston (7) is set to be at the ignition position in cycle A.

FIG. 19.6 The piston (1) is set to be at the ignition position in cycle B.

FIG. 19.7 The piston (3) is set to be at the ignition position in cycle C.

FIG. 19.8 The piston (5) is set to be at the ignition position in cycle D.

The operation of the design A.4 engine which is of 4 parallel rail type cylinders is that in every cycle A, cycle B, cycle C, cycle D, each time there is one piston provides ignition and in one rotation of the shaft, there are 4 times of ignition and the piston will complete its operation cycle when the shaft rotates two turns in the same manner as a general 4-stroke engine. The torque derived from the parallel-rail type engine of design A.4 provides continuous power at every 90 degrees of the rotation of the transmission shaft.

Figure 9:
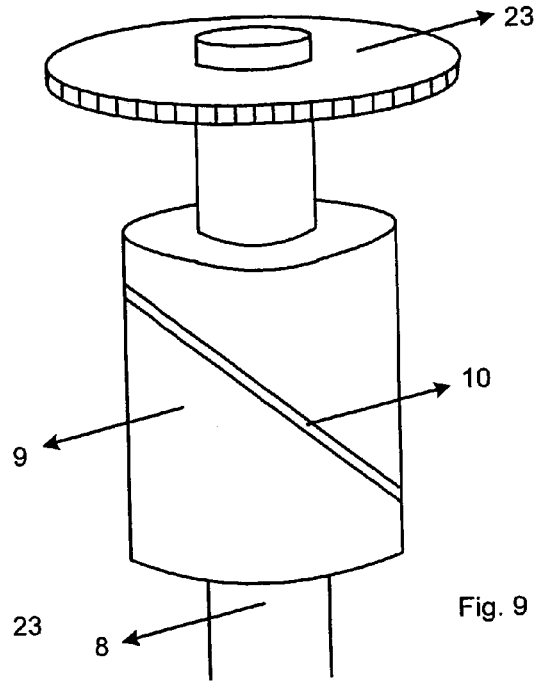
FIG. 9 A guide rail platform used with a 2-cylinder engine, and a 4-cylinder engine.

The transmission of power to the shaft in the design A.4 engine which has 2 cylinders is through a connecting rod arm to a guide rail platform which is fixedly attached to the transmission shaft. The rails in the guide rail platform of the design A.4 engine which has 2 cylinders are of a rail type, one is fitted at the highest position and one is fitted at the lowest position in the opposite direction on the platform. The rails are inclined from the highest position to the lowest position and from the lowest position to the highest position in one cycle of the guide rail platform (FIG. 9).

Referring to the guide rail platform of the design A.4 engine which has 4 cylinders, the rails in the guide rail platform can have various embodiments. For example:

A single rail having two points for the highest positions and two points for the lowest positions on the same guide rail platform. The highest positions are opposite to each other and the lowest positions are opposite to each other. The highest position forms an angle of 90 degrees and 270 degrees with the center of the guide rail platform.

The lowest position forms an angle of 180 degrees and 360 degrees with the center of the guide rail platform.

Figure 10:
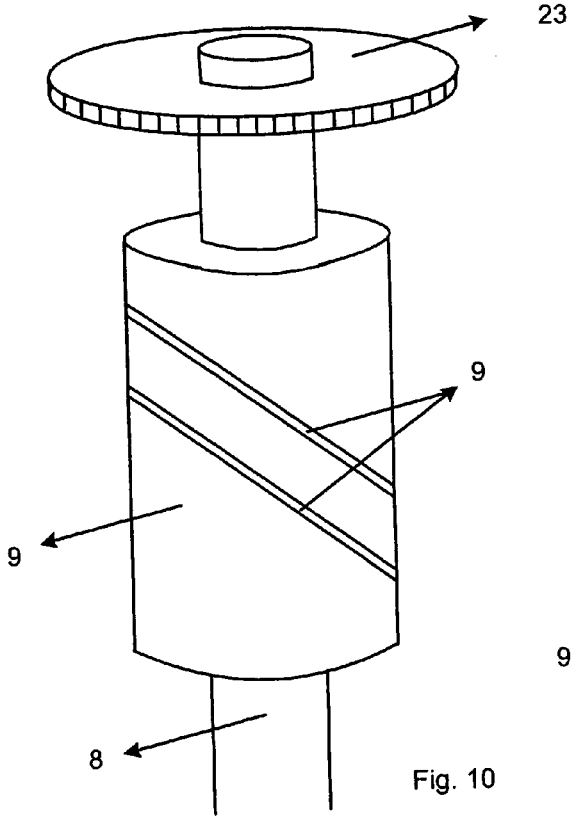
FIG. 10 A guide rail platform used with a parallel rail type 4-cylinder engine.
Figure 11:
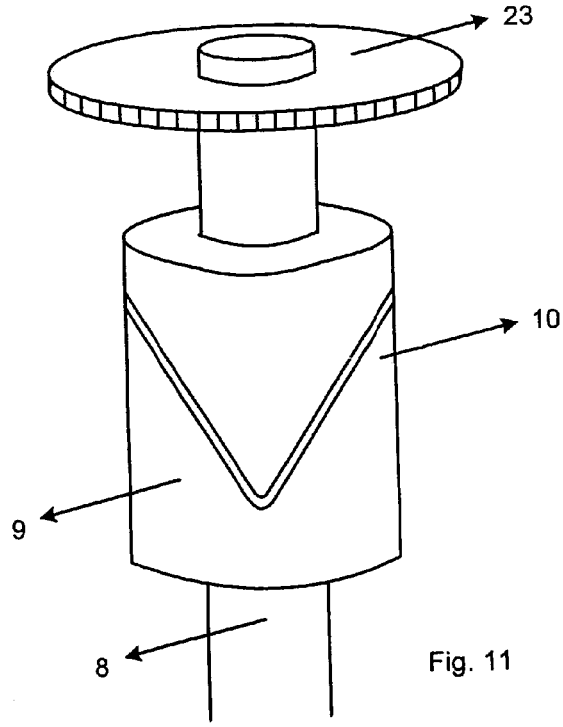
FIG. 11 A guide rail platform used with a single rail type 4-cylinder engine.

Parallel rails having a form similar to the design A.4 engine which has 2 cylinders. The rails are parallel along the same platform and the position for placing two-way cylinders is similar to the design A.4 engine which has 4 single-rail type cylinders (FIG. 10)

The disclosed two-way engine can operate as a two-stroke engine with suitable ports and this two-way engine can perfectly operate as a four-stroke diesel engine.

Any other modifications can be performed to the engine by any person skilled in the pertinent art or science without departing from the scope and objects of the present invention as stated in the claims.

BEST MODE OF THE INVENTION

As described in the heading of the full disclosure of an engine invention.

The invention claimed is:

1. Apparatus for controlling flow of air-fuel mixture to and exhaust gases from a combustion chamber of an internal combustion engine, the engine having a cylinder and a piston reciprocally traveling in the cylinder, said apparatus comprising:

a cylinder head of said cylinder;

said cylinder head having an outer wall and an inner wall defining a space therebetween:

a single rotor filling said space between said inner and outer walls and rotatable in said space around a center of the rotor;

said outer wall having a first port for intake of air-fuel mixture and a second port for outflow of exhaust gases;

said inner wall having first and second ports aligned with said ports in the outer wall;

said first and second ports in said outer wall being disposed at equal distances from the center of the rotor;

said first and second ports in said inner wall being disposed at equal distances from the center of the rotor in correspondence and alignment with said first and second ports in said outer wall;

said rotor having first and second openings at equal distances from the center of the rotor which selectively provide direct communication via said openings between said first and second ports in the outer wall and said first and second ports in said inner wall as said rotor rotates, and means for rotating said rotor in synchronism with travel of the piston in the engine so that said openings in said rotor and said ports in the inner wall of the cylinder head communicate with the ports in the outer wall of the cylinder head in correspondence with intake, compression, power and exhaust strokes of the engine, wherein said openings in the rotor are circular and the ports in the inner and the outer walls are curved slots.

2. The apparatus of claim 1, further comprising seals around the slots and the rotor between the rotor and said inner and outer walls.

3. The apparatus of claim 1, wherein said rotor has a periphery extending outside said cylinder head formed with a gear thereat.

4. The apparatus of claim 3, wherein said gear at said periphery of the rotor is in mesh with a drive gear.

5. The apparatus of claim 1 wherein said inner and outer walls have circular outlines and said curved slots in said inner and outer walls are respectively disposed in one half of the circular outlines.

6. The apparatus of claim 1 wherein said openings in said rotor are at a distance from the center of the rotor to overlap said slots during rotation of said rotor.

7. Apparatus for controlling flow of air-fuel mixture to and exhaust gases from a combustion chamber of an internal combustion engine, the engine having a cylinder and a piston reciprocally traveling in the cylinder, said apparatus comprising:

a cylinder head of said cylinder;

said cylinder head having an outer wall and an inner wall defining a space therebetween;

a single rotor filling said space between said inner and outer walls and rotatable in said space around a center of the rotor;

said outer wall having a first port for intake of air-fuel mixture and a second port for outflow of exhaust gases;

said inner wall having first and second ports aligned with said ports in the outer wall;

said first and second ports in said outer wall being disposed at equal distances from the center of the rotor;

said first and second ports in said inner wall being disposed at equal distances from the center of the rotor in correspondence and alignment with said first and second ports in said outer wall;

said rotor having first and second openings at equal distances from the center of the rotor which selectively provide direct communication via said openings between said first and second ports in the outer wall and said first and second ports in said inner wall as said rotor rotates, means for rotating said rotor in synchronism with travel of the piston in the engine so that said openings in said rotor and said ports in the inner wall of the cylinder head communicate with the ports in the outer wall of the cylinder head in correspondence with intake, compression, power and exhaust strokes of the engine, and a ball bearing on said rotor, said rotor having a central opening at which said ball bearing is disposed.

8. The apparatus of claim 7 wherein said inner wall has a high relief edge on which said rotor is rotatedly mounted via said ball bearing.

9. Apparatus for controlling flow of air-fuel mixture to and exhaust gases from a combustion chamber of an internal combustion engine, the engine having a cylinder and a piston reciprocally traveling in the cylinder, said apparatus comprising:

a cylinder head of said cylinder;

said cylinder head having an outer wall and an inner wall defining a space therebetween;

a rotor filling said space between said inner and outer walls and rotatable in said space;

said outer wall having a first port for intake of air-fuel mixture and a second port for outflow of exhaust gases;

said inner wall having first and second ports aligned with said ports in the outer wall;

said rotor having first and second openings each of which selectively provides communication between said first and second ports in the outer wall and said first and second ports in said inner wall as said rotor rotates, and means for rotating said rotor in synchronism with travel of the piston in the engine so that said openings in said rotor and said ports in said inner wall of the cylinder head communicate with the ports in the outer wall of the cylinder head in correspondence with intake, compression, power and exhaust strokes of the engine, said means for rotating said rotor comprising an arm connected to a connecting rod of the piston to travel with the piston as the piston reciprocally travels in the cylinder, a guide engaging said arm to undergo rotation as the arm reciprocally travels with the piston and a drive gear driven in rotation by said guide, said rotor being formed with an external gear thereon in mesh with said drive gear for being driven in rotation with said drive gear and thereby in synchronism with reciprocal travel of said piston.

10. The apparatus of claim 9, wherein said ports in the inner and outer walls are curved slots and the openings in the rotor are circular openings.

11. The apparatus of claim 10, further comprising seals around the openings in the rotor between the rotor and said inner and outer walls.

12. The apparatus of claim 10 wherein said curved slots in the inner and outer walls are concentric and are aligned with one another.

13. The apparatus of claim 10 wherein said arm has an end formed as a ball sleeve which is engaged with said guide to produce rotation of said guide as said piston and said arm undergo reciprocal travel.

14. The apparatus of claim 13 comprising a transmission shaft connecting said guide to said drive gear.

15. The apparatus of claim 9, wherein said rotor has a periphery extending outside said cylinder head formed with said gear thereat.

16. The apparatus of claim 15, wherein said gear at said periphery of the rotor is in mesh with said drive gear.

17. The apparatus of claim 9 wherein said engine has a second piston connected to the connecting rod at an end opposite the first said piston to form a dual piston arrangement in said cylinder.

18. The apparatus of claim 9 wherein said arm extends laterally from the connecting rod.

* * * * *